United States Patent [19]

Onodera

[11] 4,287,291

[45] Sep. 1, 1981

[54] DIFFUSION TRANSFER COLOR PHOTOGRAPHIC FILM UNIT

[75] Inventor: Kaoru Onodera, Hino, Japan

[73] Assignee: Konishiroku Photo Industry Co., Ltd., Tokyo, Japan

[21] Appl. No.: 96,311

[22] Filed: Nov. 21, 1979

[30] Foreign Application Priority Data

Nov. 23, 1978 [JP] Japan ..... 53-147692

[51] Int. Cl.[3] ..... G03C 1/40; G03C 1/10; G03C 5/54; G03C 1/28

[52] U.S. Cl. ..... 430/218; 430/217; 430/223; 430/409; 430/486; 430/487; 430/598

[58] Field of Search ..... 430/217, 218, 223, 378, 430/486, 487, 409, 410, 598

[56] References Cited

U.S. PATENT DOCUMENTS 4,030,925 6/1977 Leone et al. ..... 430/217

OTHER PUBLICATIONS

"Photographic Processes and Products," *Research Disclosure,* No. 15162, 11/1976, pp. 75–87.

*Primary Examiner*—Richard L. Schilling

*Attorney, Agent, or Firm*—Bierman & Bierman

[57] ABSTRACT

This invention relates to a light-sensitive color photographic material and more particularly to a diffusion transfer color photographic film unit, the processing composition of which contains a specific saturated aliphatic or saturated alicyclic alcohol.

10 Claims, 3 Drawing Figures

DIFFUSION TRANSFER COLOR PHOTOGRAPHIC FILM UNIT

BACKGROUND OF THE INVENTION

A variety of diffusion transfer color photographic integrated film units are heretofore known in the art, for example, in U.S. Pat. Nos. 3,415,644 3,415,645, 3,415,646, 3,647,437, 3,635,707 and 3,756,815, and Canadian Pat. Nos. 928,559 and 674,082.

In these units an image receiving layer is so designed as to be parmanently integrated with a silver halide emulsion layer or layers.

Other types of diffusion transfer color photographic film unit, for example so-called "peel-apart type", are known e.g., in U.S. Pat. Nos. 2,983,606, 3,362,819 and 3,362,821. In this type of unit, an image receiving layer is peeled apart from silver halide emulsion layers after completion of dye image-transfer process.

In these film units mentioned above, the following disadvantages are known when internal latent image type emulsions are used to directly give positive images. Namely, a fogging agent is usually used in this type of emulsion in order to render fog to unexposed silver halide particles during development. For instance, when such nonadsorptive type fogging agents as disclosed in U.S. Pat. No. 3,227,552 are used, a large amount of the fogging agent must be used to obtain sufficient dye image density, whereby the fogging agent undergoes decomposition action and generate a large amount of bubbles and thereby exert adverse influence upon photographic properties of the resulting positive image. Accordingly, the fogging agent is usually used in a small amount in order to avoid such problem, but in that case sufficient density cannot be obtained in the resulting dye image. On the other hand, when such adsorptive type fogging agents as is disclosed in Japanese Patent Publication Laid-Open-to-Public Inspection No. 53-20318/1978, are used, fogging effect may be effected even with the addition of a very small amount thereof, but, in this case, a sufficient dye image density cannot be obtained even with an increased concentration.

As a means to overcome such deffects, there is disclosed a technique in Japanese Patent Publication Laid-Open-to-Public Inspection No. 52-127233/1977, wherein glycols and/or amino alcohols are used in a processing composition for a diffusion transfer color photographic film unit comprising an internal latent image type direct positive silver halide emulsion and a non-diffusible dye releasing redox compound. These compounds have, however, such drawbacks that their image density improving effect is generally insufficient, if not at all, and that the use of the amino alcohols often result in formation of color stain.

SUMMARY OF THE INVENTION

A primary object of the present invention is to provide a diffusion transfer color photographic film unit, by which a dye image with sufficient density is obtained even when a small amount of a fogging agent is used. A secondary object of the present invention is to provide a diffusion transfer color photographic film unit, by which a dye image with sufficient density is obtained with less formation of color stain.

The above-mentioned objects and other objects of the present invention are accomplished by a diffusion transfer color photographic film unit comprising a silver halide developing agent and a fogging agent and, at the same time, containing the following components therein (a) a support having thereon at least one internal latent image type direct positive photosensitive silver halide emulsion layer in combination with a non-diffusible dye releasing redox compound, (b) an image receiving layer, and (c) an alkaline processing composition and a means for spreading said processing composition inside the film unit, said alkaline processing composition containing an unsubstituted saturated aliphatic or alicyclic monohydric alcohol having 3 to 10 carbon atoms. Further, the use of a mixture of the above-mentioned alcohols in the alkaline processing composition is also effective.

DETAILED DESCRIPTION OF THE INVENTION

Figure 1:
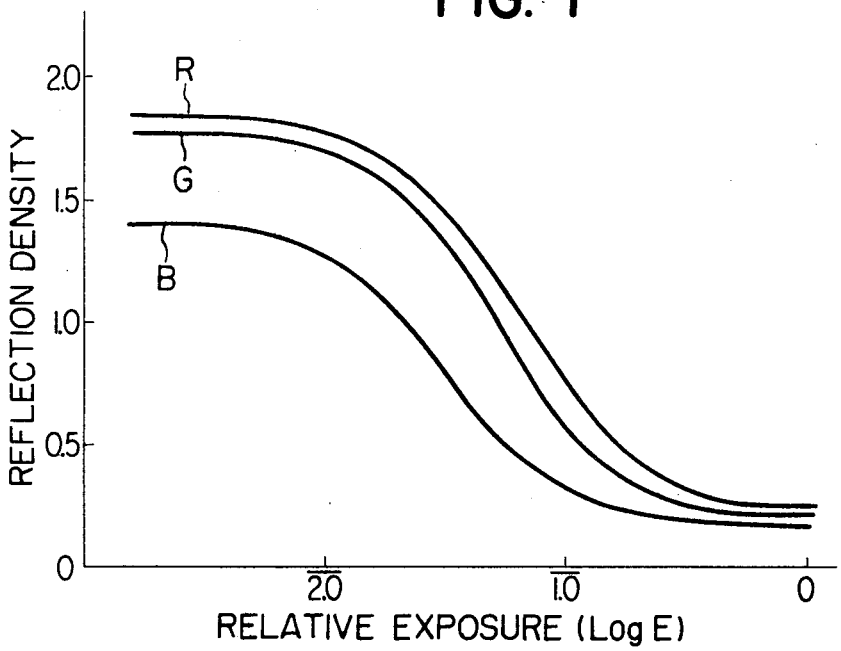

Saturated aliphatic or saturated alicyclic alcohol used in the present invention includes n-Propanol, isopropanol, n-butanol, iso-butanol, tert-butanol, sec-butanol, n-pentanol, 2-methyl-1-butanol, iso-butylcarninol, n-hexanol, 3,3-dimethyl-1-butanol, 3-hexanol, 4-heptanol, and 2,2-dimethyl-3-pentanol, cyclobutanol, cyclopentanol, cyclohexanol, cyclopentane ethanol, cyclohexane ethanol, methylcyclohexanol, cycloheptanol, cyclohexane ethanol, cyclooctanol and dimethylcyclohexanol.

Among the aliphatic and alicyclic alcohols used in the present invention, alicyclic alcohols having 3 to 10 carbon atoms are preferable, furthermore alicyclic alcohols of 4 to 8 carbon atoms are more preferable. Particularly, cyclopentanol and cyclohexanol are preferred.

Aliphatic alcohols preferably used in the present invention are straight chain aliphatic alcohols having 3 to 5 carbon atoms and particularly n-butanol and n-pentanol are preferable.

In the present invention, the above-mentioned alcohols may be used at an optional concentration, but generally at about 0.5 to about 15 g, preferably at about 0.5 to about 10 g per liter of alkaline processing composition.

An example of integrated diffusion transfer color photographic film unit and of diffusion transfer color image forming process, to which the present invention is applicable, is disclosed in Canadian Patent Specification No. 928,559. According to this example, a support for a photosensitive element is transparent and the support is provided by coating thereon an image receiving layer, light reflecting layer, opacifying layer and photosensitive layer. A rupturable pod containing therein an alkaline processing composition and an opacifying agent, such as carbon black is in this case located at a place adjacent to the uppermost layer of the photosensitive element and a cover sheet. The cover sheet comprises a transparent support and thereon are provided by coating a neutralization layer and a timing layer. The film unit is loaded on a camera and imagewise exposed to light through the transparent cover sheet, and thereafter the exposed film unit is withdrawn from the camera through a pair of pressure means provided therewithin. The rupturable pod is ruptured by means of the pressure means and thereby the processing composition and opacifying agent are spread over a image forming portion of the film unit (hence the film unit is prevented from exposure to light when it is withdrawn from the camera). The processing composition develops each silver halide emulsion layer to form a dye image therein. The dye image thus formed then diffuses into the image receiving layer and thereby to form a positive image. The positive image thus formed can be seen through the transparent support against the opaque reflecting layer as a back. Further details of this specific integrated film unit are disclosed in said Canadian Patent Specification No. 982,559 cited above.

Another example of integrated diffusion transfer color photographic film unit and diffusion transfer color image forming process to which the present invention is applicable is disclosed in U.S. Pat. No. 3,415,644. According to this embodiment, a photosensitive element comprises an opaque support and a photosensitive layer which is associated with a dye image forming substance-containing layer is provided by coating on this opaque support. A rupturable pod containing such alkaline processing composition, $TiO_2$ and an indicator dye (one of which examples is disclosed in U.S. Pat. No. 3,647,437) is located at a position adjacent to the uppermost layer of the photosensitive element and a transparent image receiving element. The image receiving element comprises a transparent support, and a neutralization layer and a timing layer coated on this transparent support. The film unit is loaded on a camera and imagewise exposed to light through the transparent image receiving element, and thereafter the exposed film unit is withdrawn from the camera through a pair of pressure means provided therewithin. The rupturable pod is ruptured by the action of the pressure means and thereby the processing composition, $TiO_2$ and indicator dye are spread over an image forming portion of the film unit (hence the film unit is prevented from exposure to light when it is withdrawn from the camera). The processing composition thus spread develops each silver halide emulsion layer to form a dye image therein. The dye image thus formed then diffuses into the image receiving layer to form a corresponding image thereon and the image thus formed can be seen through the transparent support and against a white back (the indicator dye has shifted to a colorless state because the alkali in the processing composition has already been consumed by means of the neutralization layer). Further details of this specific film unit are disclosed in U.S. Pat. No. 3,415,644. The image obtained in the manner explained above is geometrically reversed, and in order to view the image as a positive image in the image receiving layer, it is necessary to provide inside the camera with a certain type of an appropriate optical system for reversing the image, for example, a mirror for reversing a mirror image.

Preferably applicable film unit of other types of the present invention are disclosed, for example, in U.S. Pat. Nos. 3,362,819, 3,415,645, 3,415,646, 2,983,606, 2,543,181, 3,647,437 and 3,635,707, British Pat. No. 1,330,524 and Canadian Pat. No. 674,082.

A photosensitive element used in the present invention is, according to any appropriate method, processed with an alkaline processing composition in order to effect or initiate development. One preferred method for applying the processing composition to the exposed film unit is to use a rupturable pod or bag containing said processing composition. Generally, the processing composition used in the present invention may also contains a developing agent.

A non-diffusible dye releasing redox compound (hereinafter referred to as DRR compound) used in the present invention is intended to form a dye image and, in general, is a compound which is oxidized (i.e. cross oxidation) with an oxidized developing agent with the result that the oxidized compound releases a diffusible dye.

The DRR compounds usable in the present invention include those disclosed, for example, in U.S. Pat. Nos. 3,725,062, 3,698,897, 3,928,312, 3,993,638, 3,932,380, 3,932,381, 3,931,144, 3,929,760, 4,001,204, 4,013,633, 4,013,635 and 4,076,529, U.S. Patent Publication No. B-351,673, and French Pat. No. 2,284,140, Research Disclosure 13024 (1975), 15157 (1976), Japanese Patent Publication Laid-Open-to-Public. Inspection Nos. 52-8827-1977, 51-104343/1976, 51-113624/1976, 51-109928/1976, 52-7727/1977, 53-3819/1978 and 53-46730/1978, and Japanese Patent Applications Nos. 53-106462/1978 and 53-106464/1978.

Preferred embodiment of such DRR compounds are those disclosed, for example, U.S. Pat. Nos. 3,928,312, 3,929,760 3,932,380, 3,942,987, 3,954,476, 3,993,638, 4,001,204, 4,013,633 and 4,076,529, and Japanese Patent Publications Laid-Open-to-Public Inspection Nos. 51-113624/1976 and 53-46730/1978. These compounds are non-diffusible sulfonamide type compounds which, after having been oxidized, are decomposed with alkali to release non-diffusible dyes. Such sulfonamide compounds may be represented by the following general formulas I to IV.

General formula I

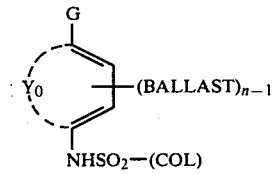

General formula II

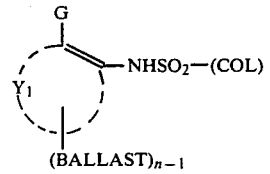

General formula III

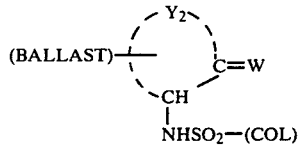

General formula IV

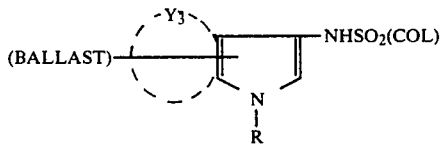

In the above formulas, (a) COL represents a dye or dye precursor component, (b) BALLAST represents an organic ballast group, e.g. a simple organic group or polymer group, said ballast group having a size and structure of molecule capable of rendering this compound non-diffusible within the photosensitive element during the course of developing the exposed film unit with an alkaline processing composition having a pH value of at least about 11, (c) G represents $OR_1$ or $NHR_2$ in which $R_1$ is hydrogen or a hydrolizable component and $R_2$ is hydrogen or a substituted or unsubstituted alkyl group having 1 to 22 carbon atoms, for example, methyl, ethyl, hydroxyethyl, propyl, butyl, sec-butyl, tert-butyl, cyclopropyl, 4-chlorobutyl, cyclobutyl, 4-nitroamyl, hexyl, cyclohexyl, octyl, decyl, octadecyl, dodecyl, benzyl or phenethyl (when $R_2$ has an alkyl group of 6 or more carbon atoms, $R_2$ may work as a part of ballast group or perform independently as a ballast group), (d) W represents oxygen atom or $=N—R_3$ in which $R_3$ represents a hydroxy or amino group, (e) Y represents a non-metal atomic group necessary for completing a benzene nucleus (this benzene nucleus may be condensed further with a 6-membered ring to form a napthalene, quinoline or 1,2,3,4-tetrahydronapthalene nucleus), $Y_1$ represents a non-metal atomic group necessary for completing a benzene nucleus as defined in the case of said $Y_0$ or a 5- to 7-membered heterocyclic ring, e.g. pyrazolone or pyrimidine, $Y_2$ represents an atomic group necessary for completing a 5- or 6-membered saturated or unsaturated non-aromatic hydrocarbon ring, for example, cyclopentane, cyclohexane, cyclopentene, cycloheznene, cycloheptane, cycloheptene, benzcyclopentane, benzcyclopentene or benzcyclohexene, and $Y_3$ represents a non-metal atomic group necessary for forming an aromatic 6-membered ring such as a benzene ring, (f) R represents hydrogen atom, a lower alkyl, aryl or heterocyclic group, and (g) n represents a positive integer of 1 or 2, and said n is 2 when G is $OR_1$ or $NHR_2$ and $R_2$ is hydrogen atom or alkyl group of less than 8 carbon atoms.

Details of the above-mentioned sulfonamide compounds and examples thereof can be referred to the patents or publications cited hereinbefore.

A film unit of the present invention can be used either for forming monochromatic or multicolor images. In the three-color photographic process, silver halide emulsion layers constituting an integrated film unit are individually in combination with a DRR compound having its main spectral absorption within a visible spectrum region of each silver halide emulsion layer.

That is, a blue-sensitive silver halide emulsion layer comprises a yellow DRR compound in combination therewith, a green-sensitive silver halide emulsion layer comprises a magenta DRR compound in combination therewith, and a red-sensitive silver halide emulsion layer comprises a cyan DRR compound in combination therewith. The DRR compounds used in combination with the above-mentioned silver halide emulsion layers may be incorporated into the respective silver halide emulsion layers or into layers adjacent to the silver emulsion layers.

Concentration of DRR compound used in the present invention can be varied within a wide range according to a specific compound used and to the results as desired. For instance, by virtue of the use of a coating solution containing DRR compound and a hydrophilic film forming natural substance or synthetic polymer binder, for example, gelatin or polyvinyl alcohol (an aqueous alkaline processing composition can permeate therethrough), the DRR compound in the form of dispersion can be coated to form a plurality of layers, and in this case the proportion of said DRR compound to said natural substance or binder is usually 1:0.25 to 4.

Effectively usable internal latent image type silver halide emulsion in the present invention is a direct positive type emulsion, in which a latent image is formed principally inside silver halide particles, and is different from such emulsion in which a latent image is formed principally on the surface portion of silver halide particles. Such internal latent image type emulsion is disclosed, for example, in U.S. Pat. No. 2,592,250 to Devey et al. or other known literatures. Other effectively usable emulsions are disclosed, for example, U.S. Pat. Nos. 3,761,276, 3,761,266, 3,761,267, 3,703,584, 3,206,313, 3,317,322, 3,850,637, 3,923,513 and 3,854,949, Japanese Patent Publications Laid-Open-to-Public Inspection Nos. 52-134721/1977, 53-66218/1978 and 53-66727/1978.

When an internal latent image type silver halide emulsion is processed after imagewise exposure in the presence of a fogging agent, a direct positive type silver image is obtained. Suitable fogging agents are hydrazine type compounds or N-substituted quaternary ammonium salts, which may be used either singly or in combination. These fogging agents are disclosed in U.S. Pat. Nos. 2,588,982, 3,227,552, 3,615,615, 3,719,494 3,734,738 and 3,718,470. Particularly, hydrazide is preferable as a fogging agent.

Preferably, the fogging agent is incorporated into silver halide emulsion layers, though the agent can be incorporated into either a processing composition or silver halide emulsion layers or layers adjacent thereto.

Although the amount of the fogging agent to be incorporated can be widely varied according to the object, generally it is 0.1 to 2.0 g per liter of the processing composition when incorporated into said composition and is 0.01 to 10 g per 1 $m^2$ of the layer when incorporated into the silver halide layer or adjacent layer.

Examples of the silver halide developing agent used in the present invention include those illustrated below.

Hydroquinone, N-methylaminophenol, phenidone (1-phenyl-4,4-dimethyl-3-pyrazolone), aminophenol, N,N-diethyl-p-phenylenediamine, 3-methyl-N,N,-diethyl-p-phenylenediamine, 4-hydroxymethyl-4-methyl-1-phenyl-3-pyrazolidone, and others.

Preferably, the silver halide developing agents are phenidone(1-phenyl-3-pyrazolidone), dimeson(1-phenyl-4,4-dimethyl-3-pyrazolidone), 4,4-bis(hydroxymethyl)-1-phenyl-3-pyrazolidone, 4-hydroxymethyl-4-methyl-1-phenyl-3-pyrazolidone, and particularly preferable is 4-hydroxymethyl-4-methyl-1-phenyl-3-pyrazolidone. The silver halide developing agent is preferably incorporated into an alkaline processing composition, but it may be incorporated into any layer in the film unit, through which the alkaline processing composition can perneate, in order to activate the agent by means of the processing composition.

In a preferable layer structure of the film unit of the present invention, a blue-sensitive emulsion layer, green-sensitive emulsion layer and red-sensitive emulsion layer are coated from exposure side in that order, and a yellow filter layer may be located between the blue-sensitive emulsion layer and green-sensitive emulsion layer, although, if necessary, these selectively sensitized silver halide emulsion layers may be arranged in any optional order. In the case of multicolor diffusion transfer process, the use of an intermediate layer is advantageous. In constituting the intermediate layer, there are used gelatin, polyacrylamide, calcium alginate, such hydrophilic polymers as partial hydrolyzate of polyvinyl acetate and hydroxypropylcellulose, including porous polymers prepared from latexes of hydrophilic polymers and hydrophobic polymers as disclosed in U.S. Pat. No. 3,625,685.

Further, there may also be used in the intermediate layer such compounds as disclosed in U.S. Pat. Nos. 3,384,483, 3,421,892, 3,427,158, 3,121,011, 3,043,692, 3,069,263, 3,615,422, 3,625,685, 3,756,816 and 3,069,264.

The silver halide emulsion layer used in the present invention comprises a photosensitive silver halide dispersed in gelatin and has about 0.6 to about 6 micron thickness. The DRR compound is dispersed in an independent layer having about 1 to about 7 micron thickness, said layer being essentially composed of a polymer binder such as gelatin, through which an aqueous alkali solution can permeate. The polymer intermediate layer through which an alkali solution can permeate is, for example, a gelatin layer having about 0.5 to about 5 micron thickness. The thickness of the layers mentioned above may be varied arbitrarily according to the object.

An alkaline solution permeable light reflecting layer used in a specific embodiment of the film unit of the present invention contains an opacifying agent dispersed in a binder. Particularly preferable light reflecting layer in one which reflects white light. Such reflecting layer is aesthetically preferable when the transferred dye image is viewed and possesses desirable optical properties for reflecting incident light. Suitable opacifying agents include, for example, titanium dioxide, barium sulfate, zinc oxide, barium stearate, silver flakes (silver powder), silicate, alumina, zirconium oxide, zirconium acetylacetate, sodium zirconium sulfate, kaolin, mica and mixtures thereof. These opacifying agents may be used in varying amounts according to a desired opacity, and may be dispersed in any binders, for example, alkaline solution permeable polymer matrix, e.g. gelatin, polyvinyl alcohol and the like. If necessary, the light reflecting layer may be incorporated with such whitening agents, for example, stilbene, cumarin, triazine and oxazole. When opacifying ability of the light reflecting layer is intended to increase, an opacifying agent of a dark color system, for example, a pH indicator dye, may be incorporated thereinto, or otherwise another independent layer adjacent to said light reflecting layer may be incorporated with carbon black, nigrosine dyes or the like.

The neutralization layer used in a specific embodiment of the present invention is usually intended to improve stability of the transferred image. Generally, this layer reduces a pH value of an image bearing layer in a short time after imbibition from about 13 or about 14 to at least 11, preferably 4 to 8. For instance, favorable results can be obtained by using such polymer acids, for example, as disclosed in U.S. Pat. No. 3,362,819, or such solid acids or metal salts, e.g. zinc acetate, zinc sulfate, magnesium acetate and the like, for example, as disclosed in U.S. Pat. No. 2,584,030. Such neutralization substances, i.e. pH-reducing substances, reduce a pH value of the film unit after development thereof to terminate the development, and further substantially lessen the occurrence of dye transfer, and thus they are able to stabilize the resulting dye image.

In the present invention, there can be used such timing layer or spacer layer as disclosed in Japanese Patent Publication Laid-Open-to-Public Inspection No. 52-127233/1977.

The image receiving layer used in the present invention preferably contains a mordant. Any mordants may be suitably used in the image receiving layer so long as they have preferable mordant effect on a diffuse transferring diffusible dye or precursor thereof. Useful mordants include, for example, poly-4-vintlpyridine, poly-4-vinyl-N-benzylpyridiniumparatolenesulfonate, cetyltrimethylammonium bromide, divinylbenzene-styrene-N-vinylbenzyl-N-benzyl-N,N-dimethylammonium chloride tercopolymers, and divinylbenzene-styrene-N-benzyl-N,N-dimethyl-N-p-(methacryloylaminophenyl)-methylammonium chloride tercopolymers. Advantageously usable mordants are disclosed in U.S. Pat. Nos. 2,882,156, 3,488,706, 3,859,096, 3,788,855, 3,227,148, 3,271,147, 3,709,690, 3,625,694, 3,770,439, 3,756,814 and 3,958,995, Belgian Pat. No. 729,202, Japanese Patent Publication Laid-Open-to-Public Inspection No. 50-61228/1975, and Japanese Patent Applications Nos. 50-66494/1975 (filed June 6, 1977), 50-127794/1977 (filed Oct. 24, 1977) and 53-96462/1978 (filed Aug. 8, 1978).

Other substances effectively usable in the image receiving layer include alkaline solution permeable polymers, for example, N-methoxymethylpolyhexylmethylene adipamide, partially hydrolized polyvinyl acetates and other substances having properties similar to those of the above-mentioned polymers. Generally, favorable results can be obtained when an alkaline solution permeable image receiving layer is preferably transparent and has a thickness of about 1 to about 5 um. Further, the image receiving layer may contain an ultraviolet absorbing substance in order to prevent the mordanted dye image from fading due to ultraviolet ray and also may contain such whitening agents as stilbene, cumarin, triazine, oxazole and the like, and dye stabilizers such as chromanol, alkyl phenol and the like.

The alkaline processing composition used in the present invention contains such compounds as mentioned above and a conventionally known aqueous alkaline solutions, for example, sodium hydroxide and sodium carbonate or such amine for example diethylamine, and a pH value of this composition is at least about 11, and is preferably contains the above-mentioned developing agent. This solution preferably contains further a viscosity increasing compound such as high molecular weight polymers. The viscosity increasing compound includes, for example, water-soluble ethers inert to an alkaline solution, for example, hydroxyethylcellulose, or alkali metal salts of carboxymethylcellulose, for example, sodium carboxymethylcellulose. A concentration of the viscosity increasing compound is advantageously about 1 to about 10% by weight based on the processing composition, and thus the compound can impart a viscosity of about 100 to about 300,00 cps to the processing composition. In a specific embodiment of the present invention, an opacifying agent, for example, $TiO_2$, carbon black and indicator dyes, may be incorporated into the processing composition. Further, a ballast bond, indicator dye and dye precursor may be made present in the integrated photographic unit, and in that case the indicator dye and dye precursor are made present in an independent layer formed on the surface of the photosensitive layer to be exposed. The indicator dye is preferably transparent during exposure and, after contact with alkali of the processing composition, it comes to assume color or becomes opaque.

Any conventionally known photographic supports can be in the film unit of the present invention, and they may be either transparent or opaque according to the object.

Water vapor permeable supports or oxygen isolating supports as disclosed in U.S. Pat. No. 3,573,044 may also be advantageously used. When a transparent support is used, the support is preferably colored to such an extent that fogging of the emulsion layer due to leakage of light through edge protions of the support at the time of processing may be prevented without hindering exposure of the film unit and observation of the resulting image.

A rupturable pod or bag is used as a means for spreading the processing composition inside the film unit of the present invention. The receptacle or bag includes those disclosed in U.S. Pat. Nos. 2,543,181, 2,643,886, 2,653,732, 2,723,051, 3,056,492, 3,056,491 and 3,152,515. Furthermore, this receptacle or bag is generally prepared from a laminated body comprising paper or metallic foil and polymer interlining, for example, polyvinyl chloride polymers. This laminated body is usually bended in the lengthwise direction to form two wall portions and these wall potions are sealed along the lengthwise circumferential portion and the end circumferential portion to form a cavity. That is the processing composition is held in this cavity.

A silver halide emulsion used in the present invention may be spectrally sensitized with sensitizing dyes in the manner as disclosed in Japanese Patent Application No. 52-2558/1977.

Preferably usable sensitizing dyes in the present invention include anhydro-3,3'-di-(3-sulfopropyl)-5,5'-diphenyl-9-ethyloxacarbocyanine hydroxide, anhydro-3,3'-di-(3-sulfopropyl)-9-ethyl-5,6,5', 6'-dibenzooxacarbocyanine hydroxide, anhydro-3,3'-di(3-sulfopropyl)-5,5'-dimethyl-9-ethylthiacarbocyanine hydroxide, and anhydro-3-ethyl-1'-ethyl-3'-(3-sulfopropyl)-5'-trifluoromethyl-benzimidazolo-4,5-benzothiacarbocyanine hydroxide in combination with anhydro-3,3'-di(3-sulfopropyl)-5,5'-dichloro-9-ethylthiacarbocyanine hydroxide. The emulsions may be stabilized with triazoles, imidazoles, azaindenes, quaternary benzothiazolium compounds, zinc or cadmium compounds, and also may contain quaternary ammonium salt type or polyethylene glycol type sensitizing compounds. Further, the emulsions may contain suitable photographic additives such as plasticizers, gelatin hardeners, coating aids, antifoggants and ultraviolet absorbers.

In accordance with the present invention, there can be obtained excellent images wherein maximum density (Dmax) of dye image is high and minimum density (Dmin) of dye image is very low and consequently dye image obtained is favorable in whiteness and comes to have a high contrast. In the prior art process, on the other hand, there was a tendency that when Dmax is intended to be enhanced an increase in Dmin is brought about, and when Dmax is intended to be kept at a low level, a decrease in Dmin is brought about. In the present invention, however, excellent images can be obtained by virtue of exhibiting a surprising effect that not only Dmin is kept at a low level but also Dmax is increased.

According to the present invention, the resulting dye image can be viewed at an early stage after initiation of development of the exposed film unit because the compound of the present invention present in the processing composition is effective in promoting action of the development. This is a great advantage in diffusion transfer color photographic film units which are used in most cases as instant photographic materials. The film unit of the present invention can afford the so-called silver economization, wherein a sufficient dye image can be obtained even when the amount of silver halide used in the photosensitive element is relatively small.

In accordance with the present invention, there can be obtained such practically useful advantages that after preparation of emulsions and after preparation of photosensitive elements, photographic speed and color balance can be remedied. This remedy can be accomplished by the fact that by virtue of employing the compound of the present invention to be present in the processing composition, an arbitrary Dmax can be obtained and Dmax of a specific emulsion layer can be selectively increased.

The advantage of using the present invention is related to the rupturable pod and solvent action of the present compound to be present in the processing composition contained in said receptacle. That is, the present compound has practically no solvent action on the inner wall of the rupturable receptacle or bag, and hence there is no possibility of swelling photographic films or deteriorating a pressure-sensitive seal used in the film unit.

The present invention is illustrated with reference to the following examples.

EXAMPLE 1

A three-color diffusion transfer photographic photosensitve element was prepared by coating successively the following layers on a transparent polyethylene terephthalate film support of 150 μm thickness.

(1) Image receiving layer comprising a ternary copolymer of styrene, N-vinylbenzl-N-benzyl-N,N-dimethylammonium chloride and divinylbenzene (mole ratio:49/49/2) (23 mg/100 $cm^2$) and gelatin (22 mg/100 $cm^2$), (2) Light reflecting layer comprising titanium dioxide (230 mg/100 $cm^2$) and gelatin (22 mg/100 $cm^2$), (3) Black opacifying layer comprising carbon black (25 mg/100 $cm^2$) and gelatin (17 mg/100 $cm^2$), (4) Cyan DRR compound containing layer comprising cyan DRR compound A (6 mg/100 $cm^2$), N,N-diethyllaurylamide (6 mg/100 $cm^2$) and gelatin (17 mg/100 $cm^2$), (5) Photosensitive silver halide emulsion layer comprising a red-sensitive internal latent image type direct positive silver bromide emulsion (14.0 mg/100 $cm^2$ based on silver), potassium 2-sec-octadecylhydroquinone-5-sulfonate (1.0 mg/100 $cm^2$), 1-[4-(2-formylhydrazidno)phenyl]-3-phenylthiourea (2 mg per mole of silver) and gelatin (16.5 mg/100 $cm^2$), (6) Intermediate layer comprising 2,5-di-tert-octyhydroquinone (6.0 mg/100 $cm^2$), dibutyl phthalate (3 mg/100 $cm^2$) and gelatin (15 mg/100 $cm^2$), (7) Magenta DRR compound containing layer comprising magenta DRR compound B (7.0 mg/100 $cm^2$), N,N-diethyllaurylamide (7.0 mg/100 $cm^2$) and gelatin (17 mg/100 $cm^2$), (8) Photosensitive silver halide emulsion layer comprising a green-sensitive internal latent image type direct positive silver bromide emulsion (14.0 mg/100 $cm^2$ based on silver), potassium 2-sec-octadecylhydroquinone-5-sulfonate, 1-[4-(2-formylhydrazino)phenyl]-3-phenylthiourea (2 mg per mole of silver) and gelatin (17.0 mg/100 $cm^2$), (9) Intermediate layer comprising 2,5-tert-octylhydroquinone (6.2 mg/100 $cm^2$), dibutyl phthalate (3 mg/100 $cm^2$) and gelatin (15 mg/100 $cm^2$),

(10) Yellow DRR compound containing layer comprising yellow DRR compound C (10 mg/100 cm$^2$), N,N-diethyllaurylamide (10 mg/100 cm$^2$) and gelatin (17 mg/100 cm$^2$),

(11) Photosensitive silver halide emulsion layer comprising a blue-sensitive internal latent image type direct positive silver bromide emulsion (16.0 mg/100 cm$^2$ based on silver), potassium 2-sec-octadecylhydroquinone-5-sulfonate (1.0 mg/100 cm$^2$), 1-[4-(2-formylhydrazino)phenyl]-3-phenylthiourea (6 mg per mole of silver) and gelatin (16.5 mg/100 cm$^2$), and

(12) Protective layer comprising tetrakis (vinylsulfonylmethyl) methane (0.8 mg/100 cm$^2$), 2,5-di-tert-octylhydroquinone (6 mg/100 cm$^2$), dibutyl phtnalate (2 mg/100 cm$^2$) and gelatin (10.0 mg/100 cm$^2$).

Cyan DRR compound A

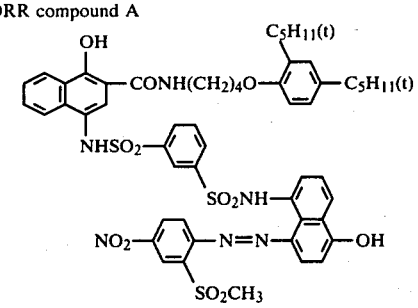

Magenta DRR compound B

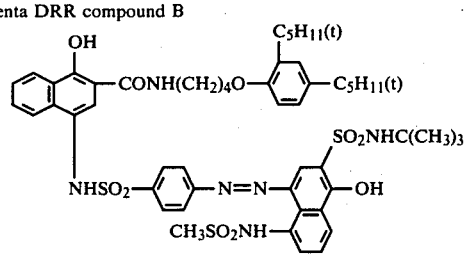

Yellow DRR compound C

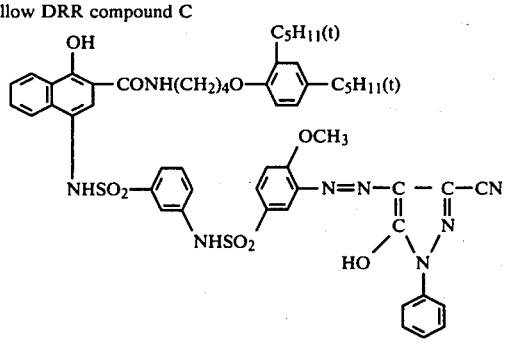

Subsequently, a cover sheet was prepared by coating the following layers successively on a transparent polyethylene terephthalate film support having 100 micron thickness.

(a) Neutralization layer comprising a copolymer of acrylic acid and butyl acrylate (weight ratio: 70/30) (200 mg/100 cm$^2$), and (b) Timing layer comprising cellulose diacetate (acetylation degree: 55 mol%) (57 mg/100 cm$^2$).

The photosensitive element as prepared was subjected to predetermined exposure to light through an optical wedge comprising a total of 30 steps of silver wedge with the density difference of 0.15, and thereafter the cover sheet as prepared above was superposed on the photosensitive element, and a pod containing each of the following alkaline processing compositions A to F is affixed therebetween. The pod was ruptured by passing it through between a pair of compressively juxtaposed rollers and the contents of the pod was allowed to spread over a space between the aforesaid protective layer (12) and the timing layer (b) of the cover sheet so that the thickness of stratum of the processing composition became 80 microns.

Processing composition A (Blank):

Potassium hydroxide: 56 g
Sodium sulfite: 2.0 g
4-Hydroxymethyl-4-methyl-1-phenyl-3-pyrazolidone: 8.4 g
5-Methylbenzotriazole: 2.8 g
2-tert-Butylhydroquinone: 0.3 g
Carbon black (Laben-450, produced by Columbia Carbon Co.): 160 g
Carboxymethylcellulose sodium salt (a high viscosity type, produced by Tokyo Kasei): 60 g
Distilled water to make: 1000.0 ml Processing composition B (Comparative):

This has the same composition as processing composition A but 5 g/l of 1,4-cyclohexane dimethanol was added thereto.

Processing composition C (Comparative):

This has the same composition as processing composition A but 5 g/l of 1,6-hexanediol was added thereto.

Processing composition D (Present invention):

This has the same composition as processing composition A but 5 ml/l of cyclobutanol was added thereto.

Processing composition E (Present invention):

This has the same composition as processing composition A but 5 ml/l of cyclopentanol was added thereto.

Processing composition F (Present invention):

This has the same composition as processing composition A but 5 ml/l of cyclohexanol was added thereto.

Table 1 shows the results of increases in density obtained by using the present compounds and comparative compounds respectively. Maximum densities (Dmax) of blue, green and red in the sample using the blank processing composition were 1.51, 1.62 and 1.74, respectively. The increases in density of samples processed with the processing compositions D-F containing the present compounds and processing compositions B and C containing the comparative compounds, as measured at an exposure amount (log E) at which the sample processed with the blank processing composition A shows a density of 1.0, were shown in Table 1.

TABLE 1

| Processing composition | Density increase from D = 1.0 | | |
|---|---|---|---|
| | Blue | Green | Red |
| A (Blank) | 0 | 0 | 0 |
| B (Comparative) | 0.57 | 0.55 | 0.65 |
| C (Comparative) | 0.60 | 0.57 | 0.75 |
| D (Present invention) | 0.85 | 0.75 | 0.80 |
| E (Present invention) | 0.90 | 0.72 | 0.82 |
| F (Present invention) | 0.86 | 0.75 | 0.50 |

From the above table, it is clearly understood that the present compounds exhibit their effect to increase transfer red dye density and, at the same time, are excellent in their efficiency as compared with the comparative compound.

EXAMPLE 2

Samples were prepared in the same manner as in Example 1, except that the timing layer (B) of the cover sheet was incorporated with 5-(2-cyanoethylthio)-1-phenyltetrazole so that the coverage thereof became 2.3 mg/100 $cm^2$ and thereon further was coated the following layer (c) and the following processing compositions G through M were used, and the exposure and the processing were carried out in the same manner as in Example 1.

Layer (c): Timing layer comprising a ternary copolymer of acrylonitrile, vinylidene chloride and acrylic acid (weight ratio: 15/79/6) (21 mg/100 $cm^2$).

Processing composition G (Blank):
- Potassium hydroxide: 40 g
- Sodium hydroxide: 3.4 g
- 4-Hydroxymethyl-4-methyl-1-phenyl-3-pyrazolidone: 8.0 g
- Sodium sulfite: 1.0 g
- 5-Methylbenzotriazole: 3.4 g
- 2-tert-Butylhydroquinone: 0.2 g
- Carboxymethylcellulose sodium salt: 45.0 g
- Carbon black: 160.0 g
- Distilled water to make: 1,000.0 ml Processing composition H (Comparative):
This has the same composition as processing composition G but 10 ml/l of 3-amino-1-propanol was added thereto.

Processing composition I (Comparative):
This has the same composition as processing composition G but 10 ml/l of 2-amino-2-methylpropanol was added thereto.

Processing composition J (Comparative):
This is the same as the processing composition G but 10 ml/l of propylene glycol was added thereto.

Processing composition K (Present invention):
This is the same as the processing composition G but 10 ml/l of n-propanol was added thereto.

Processing composition L (Present invention):
This is the same as the processing composition G but 10 ml/l of iso-propanol was added thereto.

Processing composition M (Present invention):
This is the same as the processing composition G but 10 ml/l of 2-methyl-1-propanol (iso-butanol) was added thereto.

The results obtained were as shown in Table 2.

TABLE 2

| Processing composition | Blue | | Green | | Red | |
|---|---|---|---|---|---|---|
| | Dmax. | Dmin. | Dmax. | Dmin. | Dmax. | Dmin. |
| G (Blank) | 0.71 | 0.18 | 0.80 | 0.22 | 1.22 | 0.23 |
| H (Comparative) | 0.85 | 0.20 | 1.40 | 0.38 | 2.01 | 0.31 |
| I (Comparative) | 0.71 | 0.19 | 0.80 | 0.25 | 1.24 | 0.25 |
| J (Comparative) | 0.73 | 0.18 | 1.02 | 0.24 | 1.41 | 0.31 |
| K (Present invention) | 1.15 | 0.18 | 1.51 | 0.23 | 2.07 | 0.25 |
| L (Present invention) | 1.18 | 0.19 | 1.45 | 0.24 | 2.02 | 0.27 |
| M (Present invention) | 1.10 | 0.18 | 1.38 | 0.23 | 1.89 | 0.24 |

From the above table, it is understood that although the comparative compounds exhibit their effect to increase Dmax, its degree is relatively small. On the other hand, it is clearly understood that the present compounds have such advantage that a rate of increase in Dmax in the present compounds is greater than that of the comparative compounds with reduced increase of Dmin.

EXAMPLE 3

Samples comprising the following photosensitive element and a cover sheet as described in Example 2 were exposed to light and processed in the same manner as in Example 1 except that the following processing compositions were used.

The photosensitive element was prepared by coating the following layers successively on the support as used in Example 1.

(13) Image receiving layer comprising a ternary copolymer of styrene, N,N-dimethyl-N-benzyl-N-p-(methacryloylaminophenyl)methylammonium chloride and divinylbenzene (mole ratio: 48/48/4) (27 mg/100 $cm^2$), a fluorescent whitening agent (0.4 mg/100 $cm^2$) and gelatin (27 mg/100 $cm^2$),

(14) Light reflecting layer comprising titanium oxide (230 mg/100 $cm^2$) and gelatin (22 mg/100 $cm^2$),

(15) Black opacifying layer comprising carbon black (25 mg/100 $cm^2$) and gelatin (17 mg/100 $cm^2$),

(16) Cyan DRR compound containing layer comprising cyan DRR compound D (6 mg/100 $cm^2$), 2-acetyl-5-sec-octadecylhydroquinone (0.3 mg/100 $cm^2$), N,N-ethyllaurylamide (6 mg/100 $cm^2$) and gelatin (14.4 mg/100 $cm^2$),

(17) Photosensitive silver halide emulsion layer comprising a red-sensitive internal latent image type direct positive silver bromide emulsion (11 mg/100 $cm^2$ based on silver), potassium 2-sec-octadecylhydroquinone-5-sulfonate (1 mg/100 $cm^2$), 1-acetyl-2-{4-[5-amino-2-(2,4-di-tert-amylphenoxy)benzamido]phenyl}-hydrazine (100 mg per mole of silver), 1-[4-(2-formylhydrazino)phenyl]-3-phenylthioures (0.5 mg per mole of silver) and gelatin (17.5 mg/100 $cm^2$),

(18) Intermediate layer comprising 2-acetyl-5-sec-octadecylhydroquinone (4.5 mg/100 $cm^2$), dibutyl phthalate (2.25 mg/100 $cm^2$) and gelatin (10.0 mg/100 $cm^2$),

(19) Magenta DRR compound containing layer comprising magenta DRR compound E (8.0 mg/100 $cm^2$), 2-acetyl-5-sec-octadecylhydroquinone (3.0 mg/100 $cm^2$), N,N-diethyllaurylamide (8.0 mg/100 $cm^2$) and gelatin (16 mg/100 $cm^2$),

(20) Photosensitive silver halide emulsion layer comprising a green-sensitive internal latent image type direct positive silver bromide emulsion (11 mg/100 $cm^2$ based on silver), potassium 2-sec-octadecylhydroquinone-5-sulfonate (1 mg/100 $cm^2$), 1-acetyl-2-{4-[5-amino-2-(2,4-di-tert-amylphenoxy)benzamido]phenyl}-hydrazine (300 mg/100 $cm^2$ per mole of silver), 1-[4-(2-formylhydrazino)phenyl]-3-phenylthiourea (1 mg per mole of silver) and gelatin (17.5 mg/100 $cm^2$),

(21) Intermediate layer comprising 2-acetyl-5-sec-octadecylhydroquinone (4.5 mg/100 $cm^2$), dibutyl phthalate (2.25 mg/100 $cm^2$) and gelatin (10.0 mg/100 $cm^2$),

(22) Yellow DRR compound containing layer comprising yellow DRR compound C (10.0 mg/100 $cm^2$), 2-acetyl-5-sec-octadecylhydroquinone (0.4 mg/100 $cm^2$), tricresyl phosphate (10.0 mg/100 $cm^2$) and gelatin (20.0 mg/100 $cm^2$),

(23) Photosensitive silver halide emulsion layer comprising a blue-sensitive internal latent image type direct positive silver bromide emulsion (14 mg/100 $cm^2$ based on silver), potassium 2-sec-octadecylhydroquinone (1.5 mg/100 cm²), 1-acetyl-2-{4-[5-amino-2-(2,4-di-tert-amylphenoxy)benzamido]phenyl}-hydrazine (500 mg per mole of silver), 1-[4-(2-formylhydrazino)phenyl]-3-phenylthiourea (3 mg per mole of silver) and gelatin (23 mg/100 cm²), and

(24) Protective layer comprising 2-acetyl-5-sec-octadecylhydroquinone (4.5 mg/100 cm²), 1,3,5-tri-acryloyl-hexahydro-s-triazine (2 mg/100 cm²), N,N'-bis(1-aziridinecarbonyl)hexamethylenediamine (2 mg/100 cm²) and gelatin (20 mg/100 cm²).

DRR compounds used in this Example are as follows:

Cyan DRR compound D

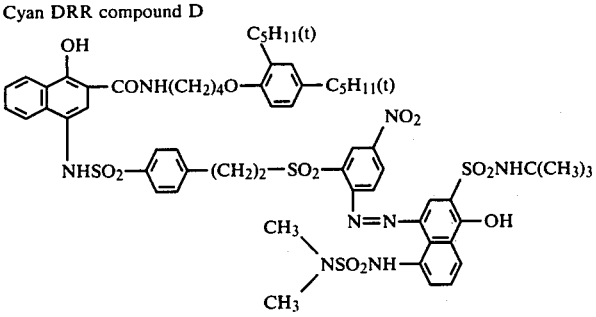

Magenta DRR compound E

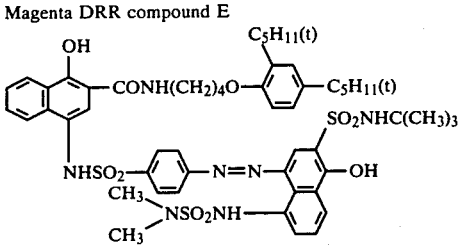

Fluorescent whitening agent

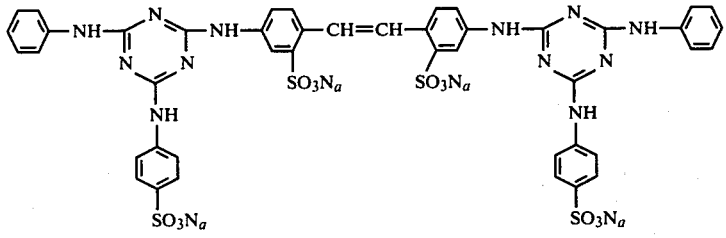

Processing composition N (Blank)

Potassium hydroxide: 67 g
Sodium hydroxide: 3.4 g
4-Hydroxymethyl-4-methyl-1-phenyl-3-pyrazolidone: 12.6 g
Sodium sulfite: 2.0 g
5-Methylbenzotriazole: 3.4 g
2-tert-Butylhydroquinone: 0.3 g
2-Methylhydroquinone: 0.1 g
Carboxymethylcellulose sodium salt: 60.0 g
Carbon black: 171 g
Distilled water to make: 1000.0 ml Processing composition O (Comparative):

This has the same composition as processing composition N but 2 ml/l of 1-amino-2-propanol was added thereto.

Processing composition P:

This has the same composition as processing composition N but 2 g/l of 1,4-cycloheaxanedimethanol was added thereto.

Processing composition Q (Present invention):

This has the same composition as processing composition N but 2 ml/l of cyclobutanol was added thereto.

Processing composition R (Present invention):

This has the same composition as processing composition N but 2 ml/l of cyclopentanol was added thereto.

Processing composition S (Present invention):

This has the same composition as processing composition N but 2 ml/l of cyclohexanol was added thereto.

Processing composition T (Present invention):

This has the same composition as processing composition N but 2 ml/l of n-pentanol was added thereto.

The samples processed with the processing compositions, respectively, were subjected to sensitometry to obtain the results as shown in Table 3.

TABLE 3

| Processing composition | Dmax | | | Dmin. | | |
|---|---|---|---|---|---|---|
| | Blue | Green | Red | Blue | Green | Red |
| N (Blank) | 1.38 | 1.75 | 1.82 | 0.18 | 0.24 | 0.26 |
| O (Comparative) | 1.36 | 1.76 | 1.83 | 0.19 | 0.30 | 0.27 |
| P (Comparative) | 1.50 | 1.89 | 2.01 | 0.18 | 0.25 | 0.26 |
| Q (Present invention) | 1.75 | 1.95 | 2.06 | 0.18 | 0.25 | 0.26 |
| R (Present invention) | 1.76 | 1.98 | 2.05 | 0.17 | 0.24 | 0.25 |
| S (Present invention) | 1.80 | 1.94 | 2.01 | 0.18 | 0.24 | 0.25 |
| T (Present invention) | 1.55 | 1.89 | 1.96 | 0.19 | 0.23 | 0.26 |

From the above table, it is understood that the compounds of the present invention are superior to the comparative compounds in that the former compounds can increase maximum density (Dmax) without increasing minimum density (Dmin) in the resulting color images. Particularly, the present compounds have such an advantage that the blue color density can be selectively increased, said advantage can be in no way expected from the comparative compounds. These advantages can be readily understood from the accompanying FIGS. 1 to 3.

Figure 2:
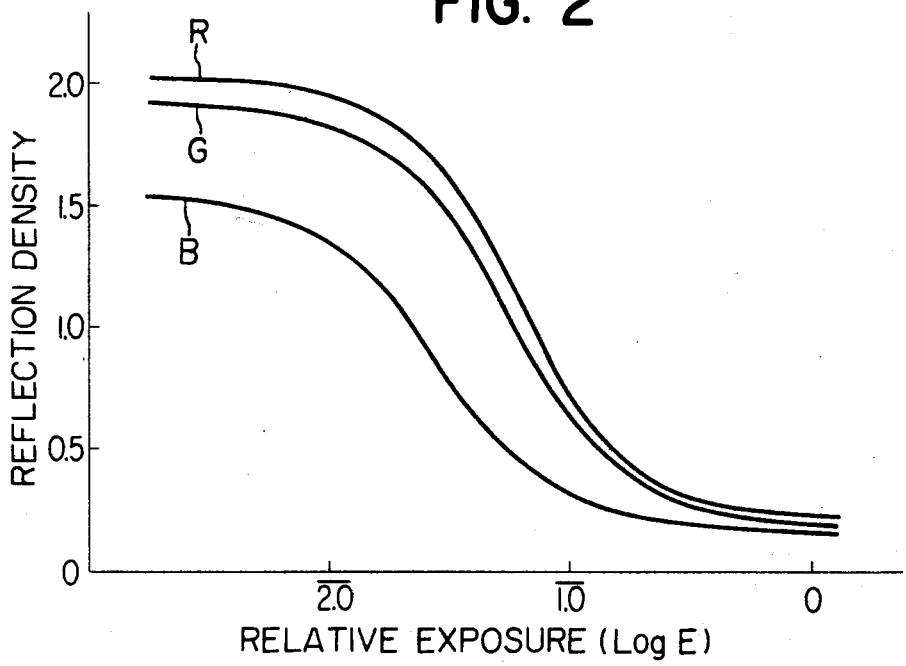
Figure 3:
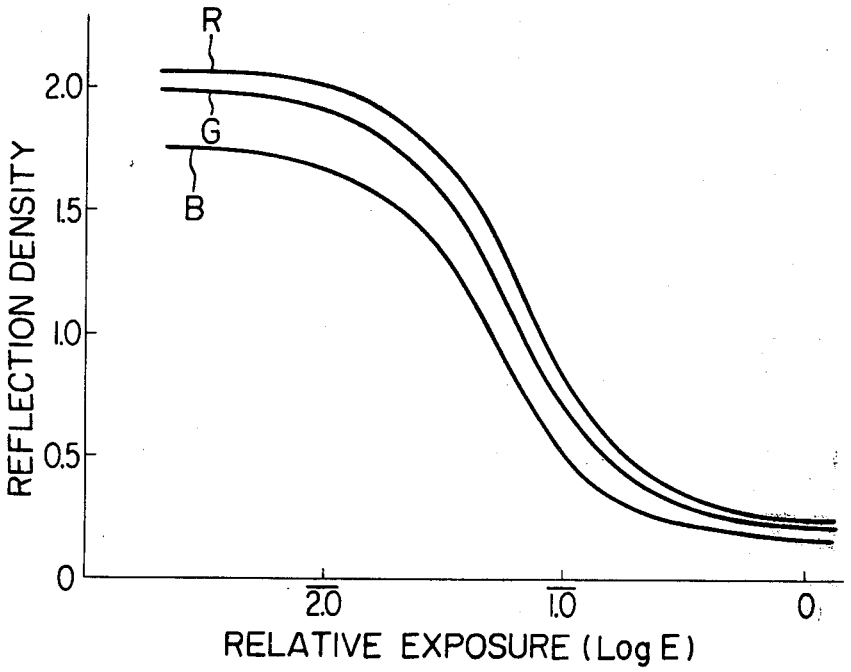

The accompanying FIGS. 1 to 3 individually show characteristic curves of dye images obtained in Example 3. FIG. 1 shows the characteristic curve obtained by the use of the processing composition N(Blank), FIG. 2 shows that obtained by the use of the processing compositions (Comparative), and FIG. 3 shows that obtained by the use of the processing compositions (Present invention). In the Figures, R represents red density, G represents green density, and B represent blue density.

We claim:

1. In a diffusion transfer color photographic film unit comprising a silver halide developing agent and a fogging agent and, at the same time, containing the following components therein (a) a support having thereon at least one internal latent image type direct positive photosensitive silver halide emulsion layer in combination with a non-diffusible dye releasing redox compound, (b) an image receiving layer, and (c) an alkaline processing composition and a means for spreading said processing composition inside the film unit, the improvement comprising the alkaline processing composition containing an unsubstituted saturated aliphatic or unsubstituted alicyclic monohydric alcohol having 3 to 10 carbon atoms.

2. The film unit according to claim 1, wherein the fogging agent is hydrazide.

3. The film unit according to claim 1, wherein the compound contained in the alkaline processing composition is a saturated alicyclic alcohol of 4 to 8 carbon atoms.

4. The film unit according to claim 1, wherein the compound contained in the alkaline processing composition is a straight chain aliphatic alcohol of 3 to 5 carbon atoms.

5. The film unit according to claim 1, wherein the compound contained in the alkaline processing composition is cyclopentanol, n-butanol or n-pentanol.

6. The film unit according to claim 1, characterized by comprising the silver halide developing agent and fogging agent and, at the same time, containing therein the following elements (a) a photosensitive element comprising a transparent support having thereon in succession the following layers: an image receiving layer, an alkaline sulution-permeable light reflecting layer, an internal latent image type direct positive red-sensitive silver halide emulsion layer in combination with a non-diffusible dye releasing redox compound, an internal latent image type direct positive green-sensitive silver halide emulsion layer in combination with a non-diffusible dye releasing redox compound and an internal latent image type direct positive blue-sensitive silver halide emulsion layer in combination with a non-diffusible dye releasing redox compound;

(b) a cover sheet comprising a transparent sheet support superposed on the blue-sensitive silver halide emulsion layer, said support being provided thereon by coating a neutralization layer and a timing layer in that order; and (c) a rupturable pod containing therein an alkaline processing composition, an opacifying agent and a compound which is said saturated aliphatic or saturated alicyclic alcohol of 3 to 10 carbon atoms, said pod being arranged within the film unit in such a manner that by a compressive force applied prior to processing the exposed film unit to the pod, the contents of said pod may be allowed to spread over a space between the transparent sheet and the blue-sensitive silver halide emulsion layer.

7. The film unit according to claim 1, wherein the developing agent is 1-phenyl-3-pyrazolidone or 4-hydroxy-4-methyl-1-phenyl-3-pyrazolidone.

8. The film unit according to claim 2, 3, 4, 5, or 1 wherein the compound contained in the alkaline processing composition is present at a concentration of about 0.5 to about 10 g/l in said composition.

9. The film unit according to claim 1, wherein the non-diffusible dye releasing redox compound is represented by the following general formulas I to IV.

General formula I

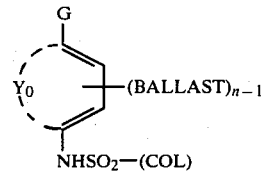

General formula II

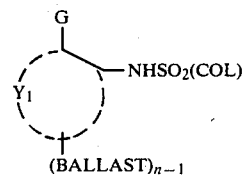

General formula III

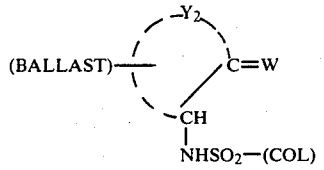

General formula IV

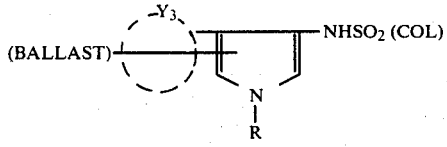

wherein

COL is a dye or dye precursor component,

BALLAST is an organic ballast group having a size and structure of molecule capable of rendering said compound non-diffusible within the photosensitive element during the course of developing said film unit after exposure with an alkaline processing composition having a pH value of at least about 11, G is $OR_1$ or $NHR_2$ in which $R_1$ is hydrogen or a hydrolyzable component and $R_2$ is hydrogen or a substituted or unsubstituted alkyl group of 1 to 22 carbon atoms, if said $R_2$ is an alkyl group of at least 6 carbon atoms, said $R_2$ may be part of said ballast group or independent thereof, W represents an oxygen atom or $=N—R_3$ in which $R_3$ represents a hydroxy or amino group, $Y_0$ represents a non-metal atomic group necessary for completing a benzene nucleus, which benzene nucleus may be condensed further with a 6-membered ring to form a naphthalene, quinoline or 1, 2, 3, 4-tetrahydronaphthalene nucleus, $Y_1$ represents a non-metal atomic group necessary for completing a 5- to 7-membered heterocyclic ring or a benzene nucleus, which benzene nucleus may be condensed further with a 6-membered ring to form a naphthalene, quinoline or 1, 2, 3, 4-tetrahydronaphthalene nucleus, $Y_2$ represents an atomic group necessary for completing a 5- or 6-membered saturated or unsaturated nonaromatic hydrocarbon ring, $Y_3$ represents a non-metal atomic group necessary for forming a 6-membered aromatic ring, R is hydrogen atom, a lower alkyl, aryl or heterocyclic group, n is a positive integer of 1 or 2, provided that n is 2 when G is $OR_1$ or $NHR_2$ and $R_2$ is hydrogen or an alkyl group of less than 8 carbon atoms.

10. The film unit according to claim 9 wherein said alkyl group for $R_2$ is methyl, ethyl, hydroxyethyl, propyl, butyl, sec-butyl, tert-butyl, cyclopropyl, 4-chlorobutyl, cyclobutyl, 4-nitroamyl, hexyl, cyclohexyl, octyl, decyl, octadecyl, dodecyl, benzyl or phenethyl.

* * * * *